US007455595B1

(12) United States Patent
Gibbons et al.

(10) Patent No.: US 7,455,595 B1
(45) Date of Patent: Nov. 25, 2008

(54) GOLF TRAINING AID

(75) Inventors: Scott Douglas Gibbons, Greenville, NC (US); Jason Neubauer, Redmond, WA (US); Vance Parker Overton, Grimesland, NC (US)

(73) Assignee: True Ympact, LLC, Greenville, NC (US)

( * ) Notice: Subject to any disclaimer, the term of this patent is extended or adjusted under 35 U.S.C. 154(b) by 0 days.

(21) Appl. No.: 11/674,891

(22) Filed: Feb. 14, 2007

(51) Int. Cl.
*A63B 69/36* (2006.01)

(52) U.S. Cl. ..... 473/212; 473/213

(58) Field of Classification Search ..... 473/207, 473/212, 213, 214, 226, 227, 266, 276
See application file for complete search history.

(56) References Cited

U.S. PATENT DOCUMENTS 5,158,298 A * 10/1992 Goins ..... 473/213
5,174,575 A * 12/1992 Leith et al. ..... 473/213
5,743,805 A * 4/1998 Richter ..... 473/213
6,471,598 B2 * 10/2002 Takase ..... 473/212
2005/0202896 A1 * 9/2005 Burke ..... 473/276
2007/0155523 A1 * 7/2007 Lesko ..... 473/212

* cited by examiner

*Primary Examiner*—Nini Legesse
(74) *Attorney, Agent, or Firm*—Coats & Bennett, P.L.L.C.

(57) ABSTRACT

A golf training aid is adapted to be worn by a golfer. When worn, the golf training aid includes a forearm support secured to the leading forearm of the golfer. Rotatively mounted to the forearm support is an arm that extends past the hands of the golfer. Secured by the remote end of the arm is a shaft retainer that receives and holds the golf club shaft while the golf club is gripped and held by the golfer. The arm extending from the forearm support to the shaft retainer permits rotation of the arm about a first axis, but generally prevents or limits movement of the arm except about the first axis. The restrictions to movement imposed by the arm generally prevent the golfer from flipping his hands during the impact portion of the swing. That is, during the impact portion of the swing at least, the back of the leading hand remains generally fixed with respect to the adjacent forearm.

20 Claims, 4 Drawing Sheets

GOLF TRAINING AID

FIELD OF THE INVENTION

The present invention relates to golf, and more particularly to a golf training aid.

BACKGROUND OF THE INVENTION

In golf the object is to score. With few exceptions golfers are motivated for an entire lifetime to improve and lower their score. This, of course, means practicing and working on parts of the game where improvements can be made and where such improvements result in lower scores. Perhaps no part of the game of golf offers the average golfer more of an opportunity to reduce his or her score than the short game. Getting "up and down" is a part of the game that most non-professionals can readily improve by engaging in a well planned and regimented practice and training schedule.

One of the most persistent problems experienced by the average or non-professional golfer lies in the inappropriate use or action of the hands during impact, particularly in the short game involving pitching and chipping. This is often referred to as flipping the hand or flipping the shaft. When this occurs, the golfer tends to move his or her hands laterally or side-to-side during impact. When the club head is pulled downwardly and just before impact or through impact, there is a great tendency for the golfer to break the wrist and attempt to flip the hands and shaft during impact. When golfers use this flipping action at impact, they find it difficult to consistently reproduce accurate shots around the green.

The proper approach, and the approach that enables golfers to consistently make good shots in and around the green and to get "up and down," is to develop a shot where the hands remain generally stationary with respect to the forearm before through impact. This, if perfected, will enable the golfer to consistently pitch and chip shots that will end up saving strokes and lowering scores.

SUMMARY OF THE INVENTION

A golf training aid is provided for maintaining the angle between the back of the leading hand and the adjacent forearm relatively constant or fixed during the impact portion of the golf swing.

In one embodiment the golf training aid includes a forearm support and one or more fasteners for securing the forearm support to the leading forearm of the golfer. A pivot assembly is secured to the forearm support and an elongated arm is secured to the pivot assembly and extends therefrom. A golf club shaft retainer is secured to an end portion of the arm opposite the pivot assembly. The pivot assembly includes a first axis and the arm can be rotated about this axis. Except for the movement about the first axis, the movement of the arm is substantially limited or restricted such that when the golf training aid is worn by the golfer, the lateral movement of the hands with respect to the forearm is substantially restricted so as to prevent the flipping action of the golfer's hands during the course of the golfer's swing, especially in the area of impact.

In one particular embodiment, the golf training aid is provided with a dual hinge pivot assembly. In this case the arm and pivot assembly includes two axes of rotation, one axis permits generally vertical movement of the hands with respect to the forearms during at least a portion of the swing, and the other axis providing only relatively limited lateral or side-to-side movement of the hands with respect to the forearms during the impact portion of the swing.

Other objects and advantages of the present invention will become apparent and obvious from a study of the following description and the accompanying drawings which are merely illustrative of such invention.

DESCRIPTION OF AN EXEMPLARY EMBODIMENT

Figure 1:
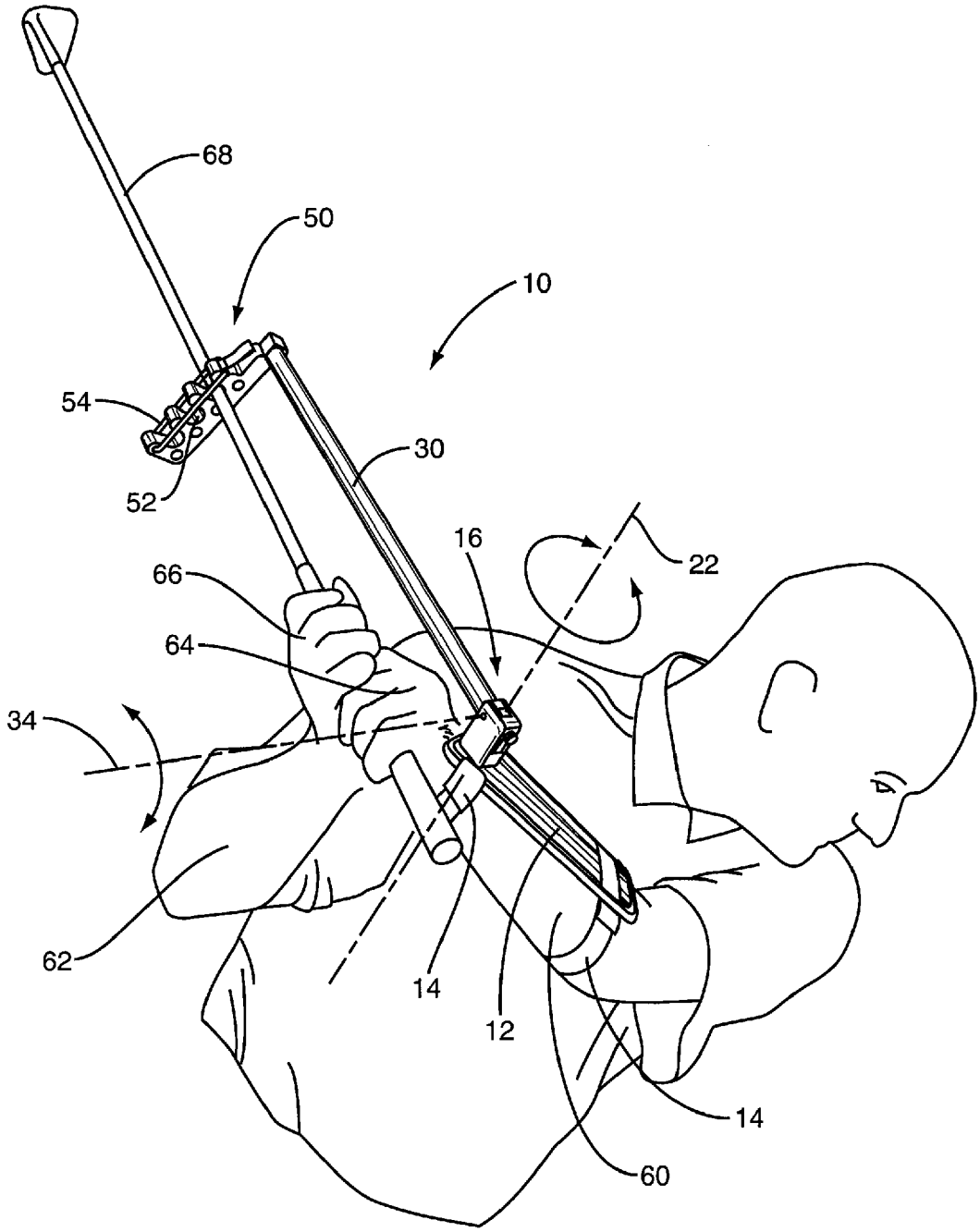
FIG. 1 is a perspective view of a golfer having the golf training aid secured to his leading forearm.

With further reference to the drawings, the golf training aid is shown therein and indicated generally by the numeral 10. As seen in FIG. 1, golf training aid 10 is designed and adapted to be worn by a golfer and to be utilized in a training regimen. As discussed below, a common problem found in a golfer's swing relates to the movement of the hands with respect to the forearms as the golfer moves the golf club through impact. More particularly, some golfers are inclined to attempt to "flip" their hands and the golf club shaft during impact. This is particularly true with shots around the green. As the golfer moves the golf club downwardly and through impact, the tendency for some golfers is to rotate the hands about the wrist in a forward direction where the hands move relative to the forearms. In this disclosure, this problem or concern is referred to as "flipping" or a "flipping action" and results from lateral or side-to-side movement of the hands with respect to the forearms. As will become apparent from a study of this disclosure, the golf training aid 10 is designed to correct this problem and to either prevent this lateral or side-to-side movement, or to substantially limit this lateral or side-to-side movement of the hand as the golf club is swung through the impact position.

Turning to a description of the golf training aid 10 of the present invention, the same includes a forearm support 12. Forearm support 12 is designed to be secured to the leading forearm 60 of the golfer. See FIG. 1. Hence, if a golfer is right-handed the forearm support 12 would be secured to the left forearm of the golfer. Forearm support 12 can be constructed and made of various materials. In the embodiment illustrated herein it is seen that the forearm support 12 is elongated and can be constructed of a lightweight material such as a plastic or other composite material. Forearm support 12 in the embodiment illustrated herein is generally flat, but it is appreciated that the same could be slightly curved to conform to the golfer's forearm. Disposed on the underside of the forearm support 12 is a pad 12A constructed of a resilient material such as foam.

Forearm support 12 includes a pair of fasteners 14 that secure the support to the golfer's forearm. Various types of fasteners can be utilized. In the embodiment illustrated herein, each fastener 14 comprises a flexible fabric belt that includes hook and loop fastening elements. This enables the forearm support 12 to be quickly and easily firmly secured on the forearm of the golfer.

As seen in the drawings, forearm support 12 includes opposite end portions. Secured to one end portion is a pivot assembly indicated generally by the numeral 16. In the particular embodiment illustrated herein, the pivot assembly 16 is in the form of a dual hinge pivot assembly. By this, it is meant that the pivot assembly 16, disclosed and shown in the drawings, includes two pivot axes. Pivot assembly 16 is rotatively mounted on a raised base 18 that forms a part of the forearm support 12. See FIG. 3. Pivot assembly 16 includes a rotating member 20. Rotating member 20 is rotatively mounted on the base 18 of the forearm support 12 for rotation about a first axis that is referred to in FIG. 1 by the numeral 22. Pivot assembly 16 can include various structures and approaches to pivotally mounting the pivot assembly on the forearm support. For example, the golf training aid may include a stud projecting up from the base 18 that receives the rotating member 20 such that the rotating member can rotate about the stud. Those individuals ordinarily skilled in the art will appreciate that the particular design of the pivot assembly 16 can vary.

Figure 2:
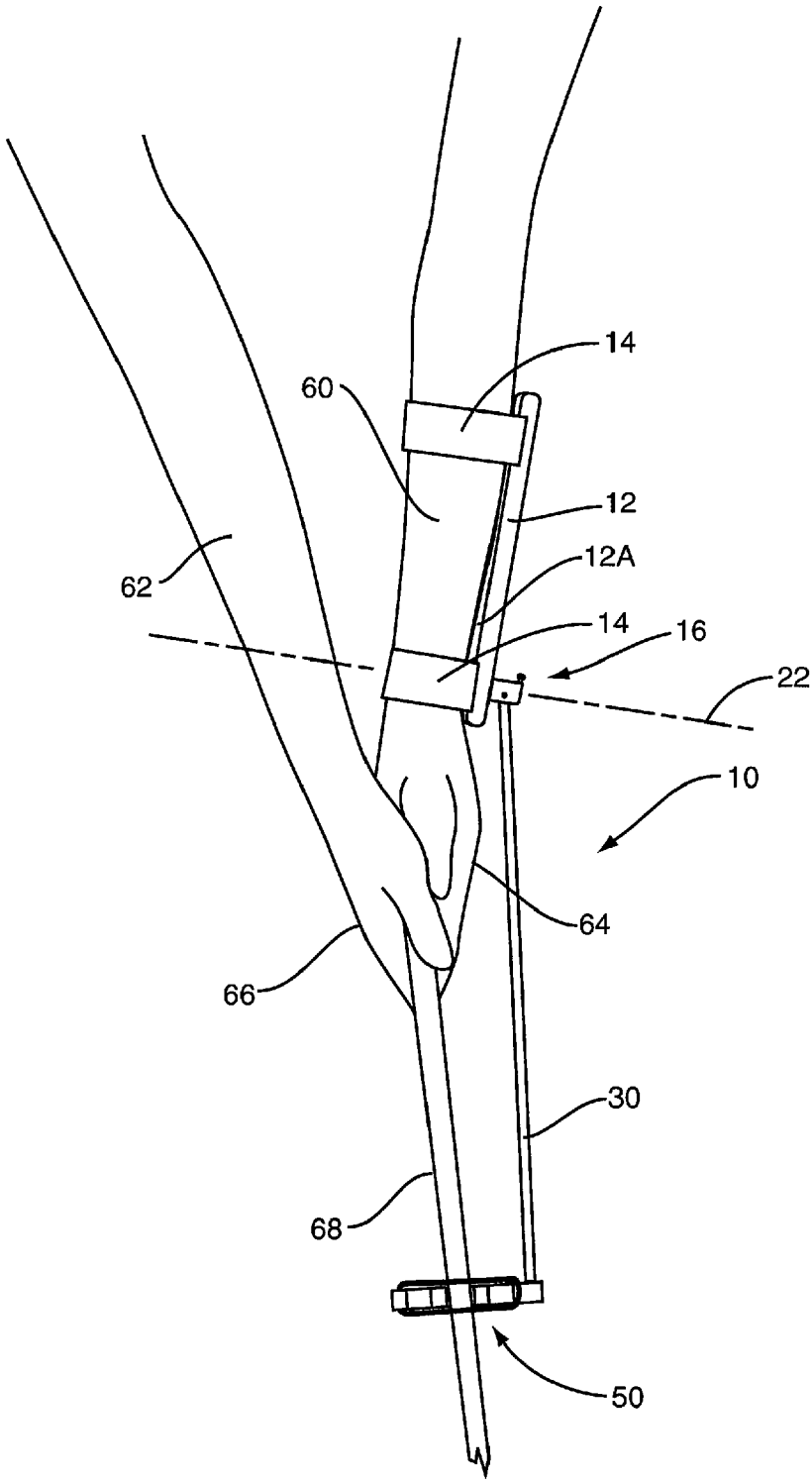
FIG. 2 is a fragmentary front elevational view showing the golf training aid secured to the leading forearm of a golfer at address.

In any event, the pivot assembly 16 pivots about the first axis 22. Note that in the case of this embodiment, the first axis 22 extends generally perpendicular to the plane of the forearm support 12. As will be appreciated from subsequent portions of this disclosure, when the golf training aid 10 is worn, the first pivot axis 22 allows the golfer's hand to move or rotate generally vertically back and forth with respect to the forearms. During a golfer's back swing for example, it is appropriate for the golfer to cock his wrist, and this results in the hand moving generally vertically with respect to the forearms. When the golfer is at address, as generally depicted in FIG. 2, the golf training aid 10 will permit the golfer to raise and lower the hands 64, 66 while maintaining the forearms 60, 62 relatively stationary. This is what is meant by vertical movement of the hands. Note in FIG. 2 that when the hands 64 and 66 are moved vertically, that is, out of the plane of the drawing, that the arm 30 rotates about the first axis 22.

Figure 3:
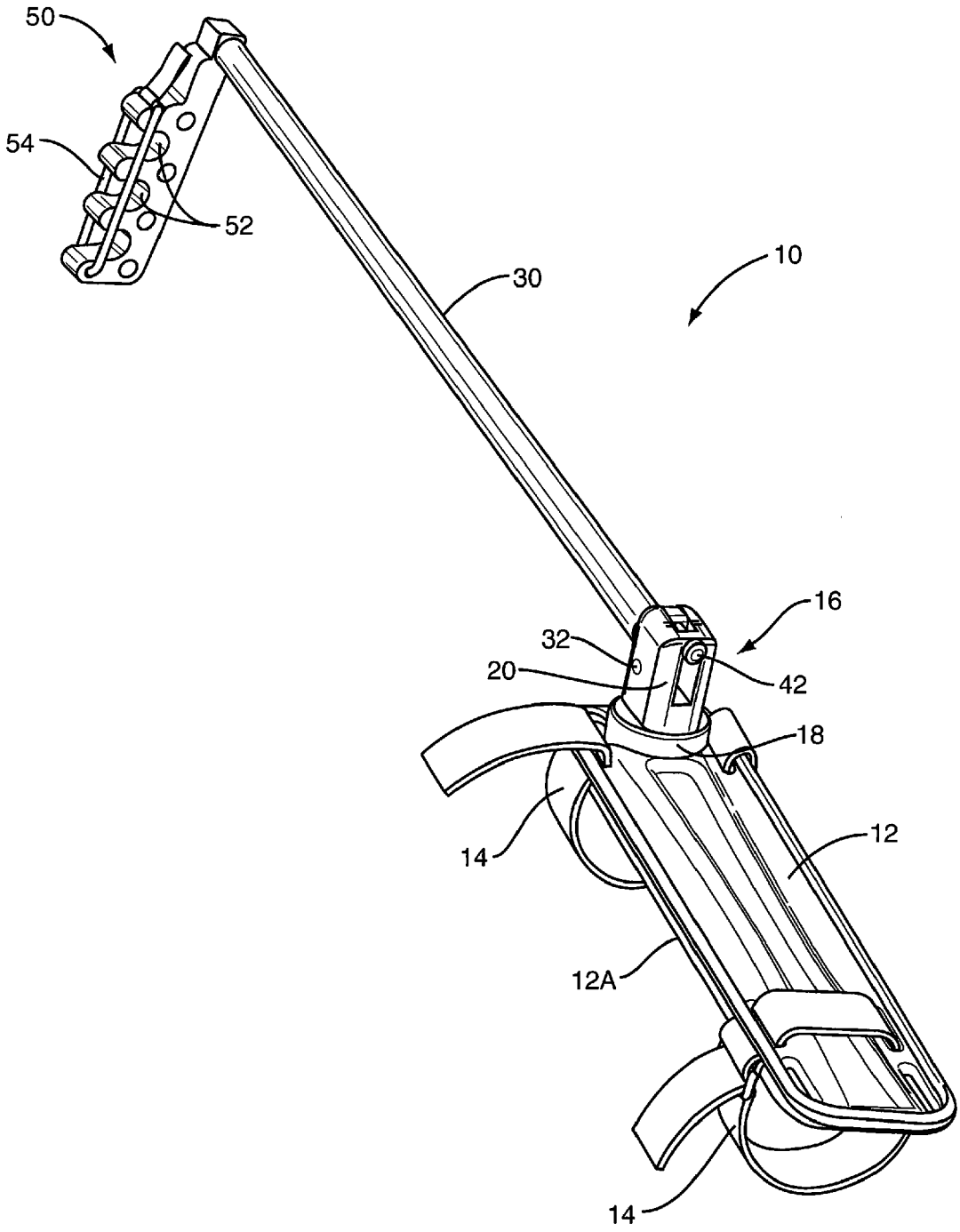
FIG. 3 is a perspective view of the golf training aid.
Figure 4:
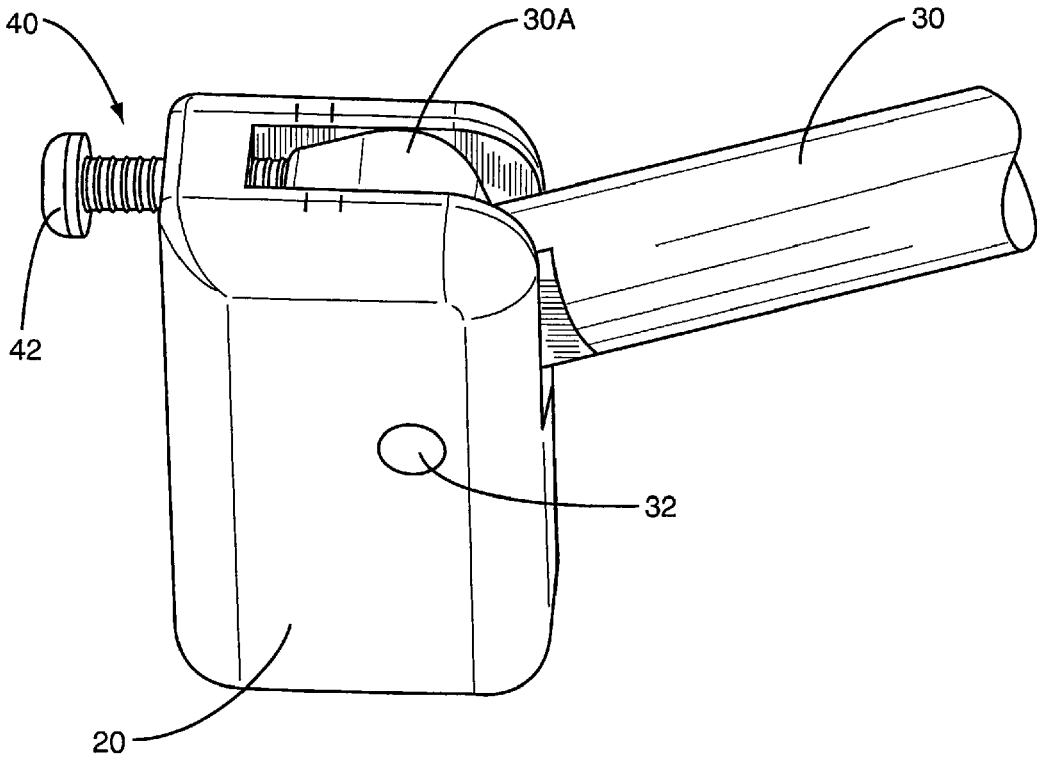
FIG. 4 is a fragmentary perspective view showing the pivot assembly.
Figure 5:
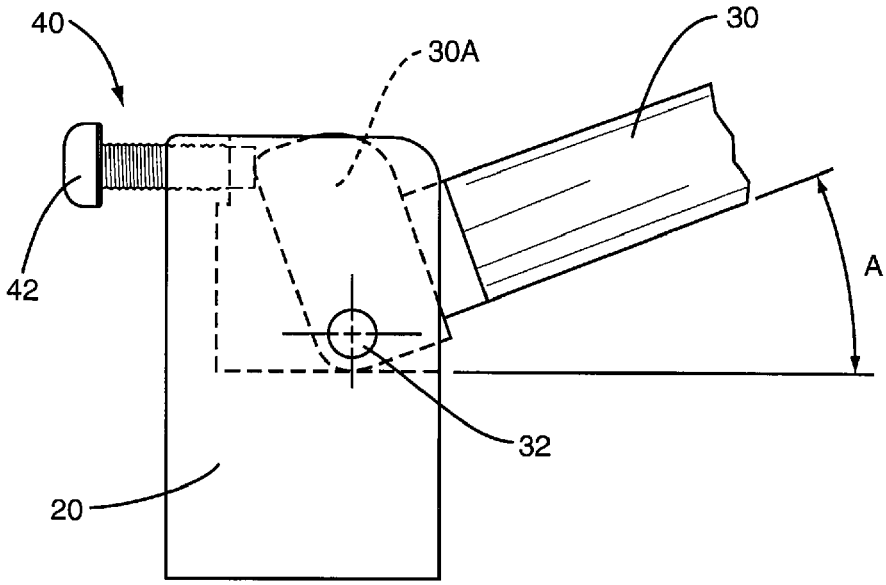
FIG. 5 is a front elevational view of the pivot assembly illustrating the adjustment mechanism incorporated therein for permitting limited rotational movement of the arm that extends from the pivot assembly to a club shaft retainer.

Secured to the pivot assembly 16, and extending therefrom, is a rigid arm 30. Arm 30 can be fixedly connected to the pivot assembly 16 or can be rotatively connected to the pivot assembly 16. In the case of the embodiment illustrated herein, arm 30 is pivotally connected to the pivot assembly 16, but is connected in such a way that the arm 30 can only experience limited rotation with respect to the pivot assembly 16. More particularly, as seen in FIGS. 3, 4 and 5, the rotating member 20 includes an open cavity. Arm 30 includes an inner portion 30A that is received and supported within this cavity. A pivot pin 32 extends through the rotating member 20 and through the inner portion 30A of the arm 30. This pivot pin 32 forms the second axis, which is indicated in FIG. 1 by the numeral 34. Generally, the pivot pin 32 would involve a frictional connection such that the arm 30 would not generally freely rotate about the second axis 34. However, the friction can be overcome and during the course of a swing, some rotation of arm 30 about the second axis 34 may occur. As discussed herein, arm 30 may experience relatively limited rotation about the second axis 34. By relatively limited rotation, it is meant that the rotation of the arm about the second axis 34 is less than the amount of rotation than the arm experienced about the first axis 22.

As seen in FIGS. 4 and 5, the arm 30 may rotate through an angle A. While this angle can vary, it is contemplated that in one embodiment, this angle would be approximately 20°.

To set this angle, there is provided an adjustment mechanism, indicated generally by the numeral 40, associated with the pivot assembly 16. In the case of the embodiment illustrated, the adjustment mechanism 40 includes an adjustable screw 42 threaded into the rotating member. Screw 42 can be screwed into contact with the inner portion 30A of the arm 30 and can be advanced such that the inner portion 30A is caused to assume a generally upright position within the cavity of the rotating member 20. When this occurs, the inner portion 30A is prohibited from rotating, and hence, the arm 30 assumes what is referred to as the zero angular position. However, by backing off the screw 42, the inner portion 30A is allowed to rock back and forth or rotate about the pivot pin 32 and about the second axis 34.

Secured to the end of the arm 30, opposite the arm's connection to the pivot assembly 16, is a shaft retainer indicated generally by the numeral 50. Note that the shaft retainer 50 extends from the arm 30 generally at a 90° angle. Shaft retainer 50 includes a series of slots 52. Respective slots 52 may be lined with a fabric or other cushioning material to prevent the shaft retainer 50 from scarring or scratching a golf club shaft 68. The respective slots 52 formed in the shaft retainer 50 are open. A closing device 54 is provided for closing the slots 52. In the embodiment illustrated herein, the closing device 54 is in the form of a stretchable elastomember. In the closed position, shown in FIG. 3, the elastomember is extended over the slots 52 and secured about an end portion of the shaft retainer. To open the slots, the elastomember is simply pulled from the closed position and moved away from the slots in order that a golf club shaft can be inserted in an appropriate slot. The provision of a plurality of slots 52 enables the golf training aid 10 to accommodate different stances and postures that various sized golfers might prefer.

With reference to FIG. 1, the golf training aid 10 is secured to the leading forearm 60 of the golfer. Note that when referring to the golfer shown therein that the trailing forearm is referred to by the numeral 62, while the leading and trailing hands are referred to by the numerals 64 and 66, respectively. In the case of FIG. 1, the golfer is a right-handed golfer, and hence the forearm support 12 is secured to the leading forearm 60. As a general rule, the forearm support 12 is secured such that it aligns with the plane of the hand when the hand is extended. In other words, the forearm support 12 is secured to the top of the forearm. A golf club is secured in the golfer's hands while the shaft 68 is retained in one of the slots 52 of the shaft retainer 50. As viewed in FIG. 1, the arm 30 connected between the pivot assembly 16 and the shaft retainer 50 is free to rotate about axis 22. Axis 22 extends generally normal to the forearm support 12 and to the top of the forearm. Rotation about this axis permits the hand of the golfer to rotate generally vertically. Again, this is sufficient in a conventional golf swing because the golf club is cocked during the back swing, or just after completion of the back swing, by moving the hands vertically with respect to the forearms.

Continuing to refer to FIG. 1, the golf training aid 10 is designed such that there is no, or limited, movement of the arm 30 about the second axis 34. In particular, as viewed in FIG. 2, the golf training aid 10 is designed to restrict or limit the movement of the leading hand 64 in the direction of the arm 30. This is because the arm 30 spans a distance between the forearm 60 and an area where the shaft retainer 50 engages and holds the club shaft 68. It is appreciated that if there is no rotation about axis 34, or if there is only limited rotation about that axis, that the leading hand 64 as shown in FIG. 2 will be substantially restricted from moving laterally to the right. Consequently, the flipping action referred to above will be prevented, or at least substantially minimized.

In some cases it may be desirable to permit limited lateral or side-to-side movement of the hands 64, 66 during a training exercise. This is because the flipping problem can be so pronounced and so ingrained into a golfer's swing that it is counter productive to attempt to totally correct the problem, at least in initial training exercises. The thought is that it may be better in certain cases to begin training with a training aid that will enable the golfer to have some limited lateral or side-to-side movement of the hands as the golf club is swung through impact. Accordingly, as illustrated in FIG. 5, the adjustment mechanism 40 can be adjusted to allow limited angular movement of the arm 30 about the second axis 34. It is envisioned that in some embodiments, this angular adjustment will allow for an angle of movement in the range of 0 to approximately 20°. As the student practices with the golf training aid 10 of the present invention and becomes more proficient at controlling the lateral or side-to-side movement of his or her hands, the angular adjustment can be closed and the goal would be to progressively get to a point where the adjustment mechanism 40 locks the arm 30, or the inner portion 30A of the arm, in the zero position.

From the foregoing specification and discussion, it is appreciated that the golf training aid 10 of the present invention is designed to help golfer's improve their swing, especially for shots close to the green. More particularly, the golf training aid 10 is aimed at helping students feel and appreciate the need for maintaining the hands fairly rigid with respect to the forearms at impact, and to rid the student of the tendency to attempt to flip the hands at impact. The better and more accepted approach to chipping or pitching is to maintain the hands generally stationary with respect to the forearm just before impact and through impact.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A golf training aid adapted to be worn on the leading forearm of a golfer to limit a flipping action of the golfer's hands during the golfer's swing, the golf training aid comprising:

a. a forearm support;

b. one or more fasteners for securing the forearm support to the leading forearm of the golfer;

c. a dual hinge pivot assembly secured to the forearm support;

d. an elongated arm secured to the dual hinge pivot assembly and extending therefrom;

e. a golf club shaft retainer secured to an end portion of the arm opposite the dual hinge pivot assembly for receiving and holding the shaft of a golf club;

f. the dual hinge pivot assembly including two axes of rotation, a first axis that permits the arm to rotate about the first axis, and a second axis that enables relatively limited rotation of the arm with respect to the dual hinge pivot assembly; and g. wherein the dual hinge pivot assembly and the second axis are oriented in the golf training aid to limit the flipping action of the golfer's hand during the course of the golfer's swing.

2. The golf training aid of claim 1 wherein the second axis is disposed generally perpendicular to the first axis.

3. The golf training aid of claim 2 wherein when the golf training aid is worn by the golfer, the first axis permits the hands of the golfer to move back and forth generally vertically with respect to the golfer's forearms and the second axis limits the lateral or side-to-side movement of the hands with respect to the forearms.

4. The golf training aid of claim 1 wherein the arm is pivotable about the second axis between an angle of approximately 0-20°.

5. The golf training aid of claim 1 wherein the dual hinge pivot assembly includes an adjustable stop that enables the range of pivotable movement of the arm to be adjusted.

6. The golf training aid of claim 1 wherein the arm extends from a support that is pivotable about the second axis, and wherein the dual hinge pivot assembly includes an adjustable stop that engages the support and either locks the support in one position or permits the support to rotate through a limited angle.

7. The golf training aid of claim 1 wherein the shaft retainer includes a series of shaft slots with each slot being adapted to receive a golf club shaft.

8. The golf training aid of claim 7 wherein the slots are open and the retainer includes a closing device for opening and closing the slots.

9. The golf training aid of claim 1 wherein the forearm support is elongated and includes opposed end portions; and wherein the dual hinge pivot assembly is mounted on one end portion.

10. The golf training aid of claim 1 wherein the arm includes an inner end portion that is rotatively mounted about the second axis, and wherein there is provided a movable adjustment device for engaging the inner end of the arm and restricting the rotational movement thereof.

11. The golf training aid device of claim 10 wherein the adjustment device permits the arm to move between any angle between approximately 0 and 20°.

12. A golf training aid adapted to be worn on the leading forearm of a golfer to limit a flipping action of the golfer's hands during the golfer's swing, the golf training aid comprising:

a. a forearm support;

b. one or more fasteners for securing the forearm support to the leading forearm of the golfer;

c. a pivot assembly secured to the forearm support;

d. an elongated arm secured to the pivot assembly and extending therefrom;

e. a golf club shaft retainer secured to an end portion of the arm opposite the pivot assembly;

f. the pivot assembly including a first axis and a second axis and wherein the arm is rotatable through a first angle about the first axis and rotatable through a second angle about the second axis, and wherein the movement of the arm about the second axis is more limited than the movement of the arm about the first axis as the second angle is less than the first angle; and g. wherein the pivot assembly and the second axis are oriented in the golf training aid to limit the flipping action of a golfer's hand during the course of the golfer's swing.

13. The golf training aid of claim 12 wherein the first axis extends generally perpendicular to the forearm support.

14. The golf training aid of claim 12 wherein the shaft retainer includes a series of shaft slots.

15. The golf training aid of claim 14 wherein the slots are open and the retainer includes a closing device for opening and closing the slots.

16. The golf training aid of claim 12 where in the forearm support is elongated and includes opposite end portions; wherein the pivot assembly is secured on one end portion adjacent a wrist portion of the golfer's arm.

17. The golf training aid of claim 12 including an adjustment device for adjusting the range of movement of the arm about the second axis such that the second angle can be varied from approximately zero degrees to approximately twenty degrees.

18. The golf training aid of claim 12 wherein when the golf training aid is worn by the golfer, the first axis permits the hands of the golfer to move back and forth generally vertical with respect to the golfer's forearms and the second axis limits the lateral or side-to-side movement of the hands with respect to the forearms.

19. The golf training aid of claim 12 wherein the pivot assembly includes an adjustable stop that enables the range of pivotal movement of the arm to be adjusted.

20. The golf training aid of claim 12 wherein the arm extends from a support that is pivotal about the second axis, and wherein the pivot assembly includes an adjustment stop that engages the support and either locks the support in one position or permits the support to rotate through a limited angle.

* * * * *